US005573883A

United States Patent [19]

Berkes et al.

[11] Patent Number: 5,573,883

[45] Date of Patent: Nov. 12, 1996

[54] METHOD FOR DEVELOPING AN LATENT IMAGE WITH LIQUID DEVELOPER HAVING A MIXTURE OF A HIGH VAPOR PRESSURE CARRIER FLUID AND A LOW VAPOR PRESSURE CARRIER FLUID

[75] Inventors: John S. Berkes, Webster; Stewart W. Volkers, Williamson; Dexter A. Dyer, Fairport, all of N.Y.

[73] Assignee: Xerox Corporation, Stamford, Conn.

[21] Appl. No.: 461,829

[22] Filed: Jun. 5, 1995

[51] Int. Cl.[6] ..... G03G 13/11

[52] U.S. Cl. ..... 430/116

[58] Field of Search ..... 430/113, 115, 430/116

[56] References Cited

U.S. PATENT DOCUMENTS 5,330,868 7/1994 Santilli et al. ..... 430/116
5,352,557 10/1994 Matsuoka et al. ..... 430/116
5,384,225 1/1995 Kurotori et al. ..... 430/116

*Primary Examiner*—John Goodrow
*Attorney, Agent, or Firm*—Lloyd F. Bean, II

[57] ABSTRACT

Disclosed is a liquid developers comprised of a mixture of high and low vapor pressure fluids, and wherein there is enabled with such developers in embodiments excellent fixing characteristics especially when the developed image is transferred from an intermediate substrate to the final substrate, such as paper. In embodiments of the present invention there is provided developers and processes for achieving high fix wherein the developers contains a high vapor pressure fluid, such as an Isopar, like ISOPAR L®, and a low vapor pressure fluid, such as NORPAR 15®, SUPURLA NF5®, and the like, and which low vapor pressure fluid is substantially odorless. The high vapor pressure fluid in embodiments is removed by heat once the developer is transferred to the intermediate substrate, and the low vapor pressure fluid remains with the developer when the developed image is transfixed, that is transferred, fixed and heated simultaneously, to a supporting substrate like paper.

14 Claims, 1 Drawing Sheet

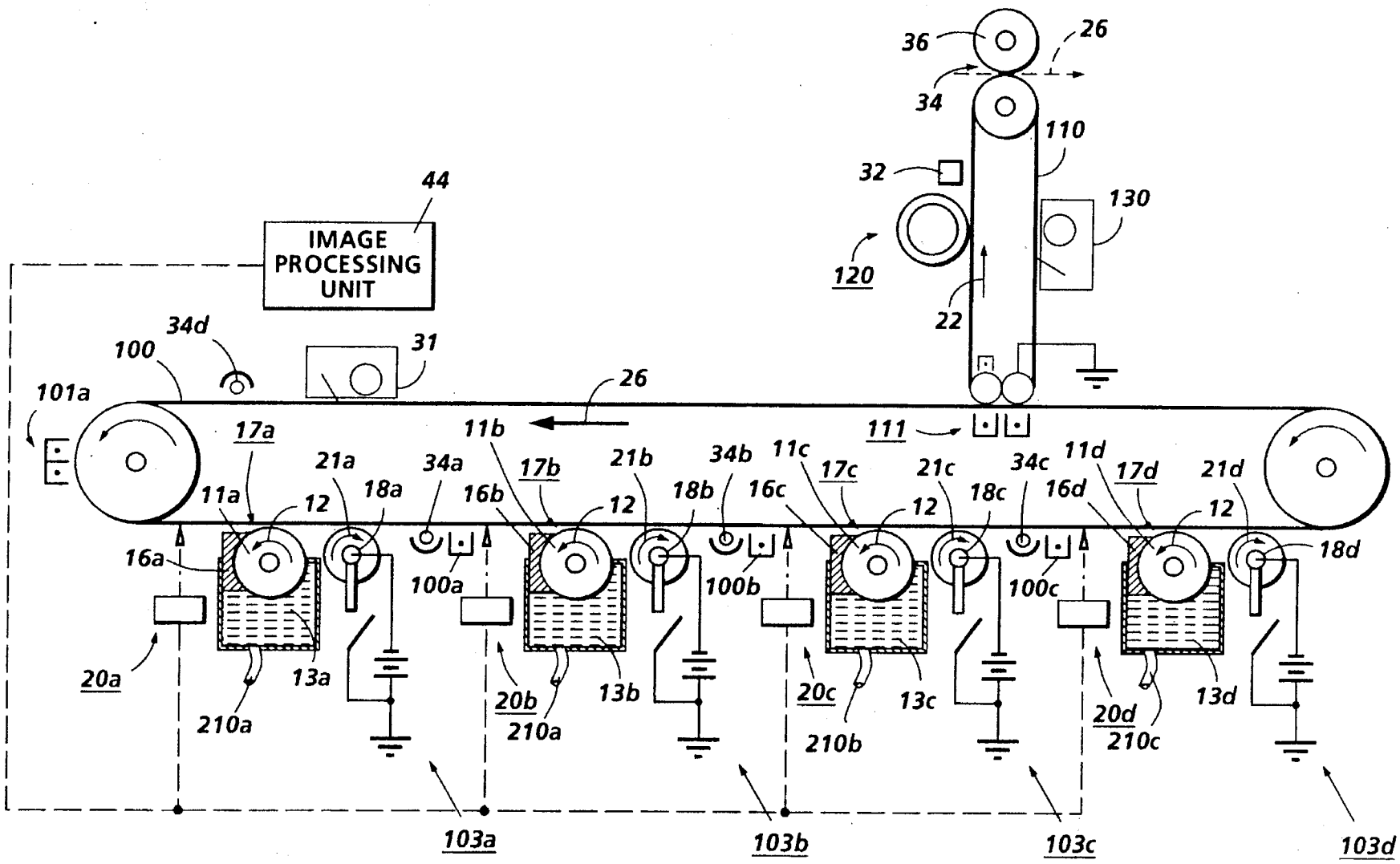
IMAGE PROCESSING UNIT
44
26
36
34
32
120
22
110
130
111
31
34d
100
101a
17a
11a
16a
20a
21a
18a
12
13a
210a
34a
100a
17b
11b
16b
20b
21b
18b
13b
34b
100b
17c
11c
16c
20c
21c
18c
13c
210b
34c
100c
17d
11d
16d
20d
21d
18d
13d
210c
103a
103b
103c
103d

METHOD FOR DEVELOPING AN LATENT IMAGE WITH LIQUID DEVELOPER HAVING A MIXTURE OF A HIGH VAPOR PRESSURE CARRIER FLUID AND A LOW VAPOR PRESSURE CARRIER FLUID

BACKGROUND OF THE INVENTION

This invention is generally directed to liquid developer compositions and, in particular, to liquid developers comprised of a mixture of high and low vapor pressure fluids, and wherein there is enabled with such developers in embodiments excellent fixing characteristics especially when the developed image is transferred from an intermediate substrate to the final substrate, such as paper, reference for example U.S. Pat. No. 5,276,492, the disclosure of which is totally incorporated herein by reference. In embodiments of the present invention there is provided developers and processes for achieving high fix wherein the developers contain a high vapor pressure fluid, such as an Isopar, like ISOPAR L®, and a low vapor pressure fluid, such as NORPAR 15®, SUPURLA NF5®, and the like, and which low vapor pressure fluid is substantially odorless. The high vapor pressure fluid in embodiments is removed by heat once the developer is transferred to the intermediate substrate, and the low vapor pressure fluid remains with the developer when the developed image is transfixed, that is transferred, fixed and heated simultaneously, to a supporting substrate like paper. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after extensive research efforts, and which toners result in, for example, sufficient particle charge for transfer and maintain the mobility within the desired range of the particular imaging system employed.

A latent electrostatic image can be developed with toner particles dispersed in an insulating nonpolar liquid. The aforementioned dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin, pigment, and a dispersant nonpolar liquid. The colored toner particles are dispersed in a nonpolar liquid which generally has a high volume resistivity in excess of 109 ohm-centimeters, a low dielectric constant, for example below 3.0, and a high vapor pressure. Generally, the toner particles are less than 10 microns in diameter as measured with the Horiba Capa 700 Particle Size Analyzer.

Since the formation of proper images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,474 the disclosure of which is hereby totally incorporated herein by reference, discloses a liquid electrostatic developer comprising a nonpolar liquid, such as the Isopars, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) vinyl toluene and styrene and (iv) of butadiene and acrylate. As the copolymer of polyethylene and methacrylic acid or methacrylic acid alkyl esters, NUCREL® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009; 5,034,299 and 5,288,508.

The disclosures of each of the U.S. Patents mentioned herein are totally incorporated herein by reference.

In U.S. Pat. No. 5,306,591 and U.S. Pat. No. 5,308,731, the disclosures of which are totally incorporated herein by reference, there is illustrated a liquid developer comprised of a nonpolar liquid, thermoplastic resin particles, a nonpolar liquid soluble ionic or zwitterionic charge director, and a charge adjuvant comprised of an aluminum hydroxycarboxylic acid, or mixtures thereof.

In copending U.S. patent application Ser. No. 08/357,471, the disclosure of which is totally incorporated herein by reference, there is illustrated a liquid developer comprised of a nonpolar liquid, thermoplastic resin particles, polar organic additives with a dielectric constant in the range of about 20 to about 150, and soluble in the nonpolar liquid; and charge director. A latent electrostatic image can be developed with toner particles dispersed in an insulating nonpolar liquid. Examples of liquids illustrated in the aforementioned copending application include the ISOPAR® series (manufactured by the Exxon Corporation), the NORPAR® series available from Exxon Corporation, the SOLTROL® series available from the Phillips Petroleum Company, and the SHELLSOL® series available from the Shell Oil Company.

SUMMARY OF THE INVENTION

It is an object of the present invention to provide liquid developers which make it easy to control the residual carrier and the toner/carrier ratio at the transfuse point and thereby achieve excellent fix.

Another object of the present invention is to provide liquid developers capable of high particle charging and fast toner charging rates and which developers contain a mixture of a high vapor pressure fluid, and a low vapor pressure fluid.

Additionally, another object of the present invention relates to imaging processes, and more specifically the development of electrostatic images with a liquid developer containing two or more carrier fluids as indicated herein, transfer of the image to an intermediate layer or substrate, removing the high vapor pressure fluid by heating, transferring, and fixing the image to a final substrate, like paper, and wherein improved fixing of the image is achievable due to the pressure of a controlled amount of carrier fluid during transfuse. Also with the liquid developers of the present invention fluids with objectionable odors, such as the Isopars are not transferred, or there is minimal transfer, to the final paper substrate.

Another object of the invention is to provide liquid developers wherein there is selected as charge directors ammonium AB diblock copolymers.

It is still a further object of the invention to provide a liquid developer wherein developed image defects, such as smearing, loss of resolution and loss of density, are eliminated, or minimized.

These and other objects of the present invention can be accomplished in embodiments by the provision of liquid developers and processes of imaging thereof. In embodiments, the present invention is directed to liquid developers comprised of a toner resin, pigment, charge adjuvant, a mixture comprised of a high vapor pressure fluid, and a low vapor pressure fluid, and a charge director. Embodiments of the present invention relate to a liquid electrostatographic developer comprised of (A) a mixture comprised of a high vapor pressure fluid, and a low vapor pressure fluid, and present in a major amount of from about 50 percent to about 98 weight percent, (B) pigment and thermoplastic resin particles having an average volume particle diameter of from about 0.5 to about 30 microns and preferably about 1.0 to about 10 microns in average volume diameter, (C) a nonpolar liquid soluble charge director compound, and (D) a charge adjuvant.

DESCRIPTION OF THE DRAWING

Other aspects of the present invention will become apparent as the following description proceeds and upon reference to the drawings, in which the Figure is a schematic, elevational view of a color electrophotographic printing machine that employs the liquid developer of the present invention therein Of importance to the present invention is the utilization of a mixture of high vapor pressure carrier fluid, and low vapor pressure carrier fluid. From a liquid development process standpoint it is important that some carrier remains with the toner at the transfuse step. The level of fix obtained improves as the % Norpar 15 is increased for a Norpar 15/Nucrell 599 developer. Practical composition limits are set by poor fix at low % carrier and image smear at high % carrier. A toner/carrier ratio of about 0.2 to about 0.6 is acceptable and about 0.5 is optimal.

Our improvement in this process is to use a mixture of low and high vapor pressure carrier fluids such as Norpar 15® and Isopar L® or Superla® and Isopar L® or a mixture of two or more of the above fluids. Preferably, the vapor pressure difference between these liquids is greater than one order of magnitude having a vapor pressure of ratio between (1/10 to 1/10,000), consequently, it is possible to preformulate a developer such that after development, low solids image conditioning and transfer to the intermediate it has a composition which is essentially 60% high vapor pressure carrier, 20% low vapor pressure carrier and 20% toner through the process steps for an ideal formulation.

| Developer State | Process | % Toner | % Low Vapor P | % High Vapor P |
|---|---|---|---|---|
| Before Imaging | | 2 | 24.5 | 73.5 |
| ↓ | Dev + LSIC + Tran | | | |
| Image on Intermediate | | 20 | 20 | 60 |
| ↓ | Evap. on Int | | | |
| At transfuse | | 50 | 50 | ~0 |

For such an ink the process conditions are selected that the time the image spends on the intermediate and the temperature of the intermediate is such that the high vapor carrier constituent is essentially gone at the transfuse point. Consequently this selection of carrier materials, their appropriate preformulation and the use of appropriate intermediate temperatures and image dwell time on the intermediate makes is relatively easy to obtain the ideal toner/carrier ratio 50/50 for optimal fix in transfuse. To achieve this with a single component carrier would be much more difficult.

Examples of high vapor pressure liquid carriers selected for the developers of the present invention include a liquid with viscosity of from about 0.5 to about 500 centipoise, preferably from about 1 to about 20 centipoise, and a resistivity greater than or equal to about $5\times10^9$ ohm/centimeters, such as $10^{13}$ ohm/centimeters, or more, such as a branched chain aliphatic hydrocarbon, having between 10 to 18 carbon atoms like the ISOPAR® series, available from the Exxon Corporation. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C.; ISOPAR L® has a mid-boiling point of approximately 194° C.; ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of about 10hu 9 ohm-centimeters and a dielectric constant below or equal to about 3.0. Moreover, the vapor pressure at 25° C. should be less than or equal to about 10 Torr in embodiments.

Examples of low vapor pressure carrier fluids, or liquids include the NORPAR® series available from Exxon Corporation. Preferably, Norpar 15® which is a linear hydrocarbon with from about 14 to about 16 carbon atoms being and a boiling point between 204° C. and 316° C. and the flash point is 118° C. is employed. Also, Superla NF® from Amoco, the SOLTROL® series from the Phillips Petroleum Company, and the SHELLSOL® series from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight. The low vapor pressure fluid is between 0.0001 to 0.25 Torr at 20° C. (Norpar 15). The high vapor pressure fluid is between 0.1 to 2.5 Torr at 20° C. (Isopar L)

Examples of charge directors include components such as (1) a protonated AB diblock copolymer of poly[2-dimethylammoniumethyl methacrylate bromide co-2-ethylhexyl methacrylate], poly[2-dimethylammoniumethyl methacrylate tosylate co-2-ethylhexyl methacrylate], poly[2-dimethylammoniumethyl methacrylate chloride co-2-ethylhexyl methacrylate], poly[2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly [2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], or poly[2-dimethylammoniumethyl methacrylate tosylate co-N,N-dibutylacrylamide]; (2) a mixture, for example 50:50, of at least two protonated AB diblock copolymers; (3) a mixture, for example 50:50, of at least one protonated AB diblock copolymer and one quarternized AB diblock copolymer, and the like. The charge directors as illustrated in the patents and copending applications mentioned herein can be selected for the developers of the present invention.

The charge director can be selected for the liquid developers in various effective amounts, such as for example in embodiments from about 0.5 percent to 80 percent by weight relative to developer solids and preferably 2 percent to 20 percent by weight relative to developer solids. Developer solids includes toner resin, pigment, and charge adjuvant. Without pigment the developer may be selected for the generation of a resist, a printing plate, and the like. Examples of other effective charge director for liquid toner particles include anionic glyceride, such as EMPHOS® D70-30C and EMPHOS® F27-85, two products sold by Witco Corporation, New York, N.Y.; which are sodium salts of phosphated mono- and diglycerides with saturated and unsaturated substituents respectively, lecithin, Basic Barium Petronate, Neutral Barium Petronate, Basic Calcium Petronate, Neutral Calcium Petronate, oil soluble petroleum sulfonates, Witco Corporation, New York, N.Y., and metallic soap charge directors such as aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmitate; calcium, cobalt, manganese, lead, zinc resinates, and the like. Other effective charge directors include AB diblock copolymers of 2-ethylhexylmethacrylate-co-methacrylic acid calcium and ammonium salts.

Any suitable thermoplastic toner resin can be selected for the liquid developers of the present invention in effective amounts of, for example, in the range of about 99 percent to 40 percent of developer solids, and preferably 95 percent to 70 percent of developer solids, which developer solids includes the thermoplastic resin, optional pigment and charge control agent, and any other component that comprises the particles. Examples of such resins include ethylene vinyl acetate (EVA) copolymers (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E. I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL®, like NUCREL 599®, NUCREL 699®, or NUCREL 960® are selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant selected may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference.

To increase the toner particle charge and, accordingly, increase the mobility and transfer latitude of the toner particles, charge adjuvants can be added to the toner particles. For example, adjuvants, such as metallic soaps, like aluminum stearate, magnesium stearate or octoate, fine particle size oxides, such as oxides of silica, alumina, titania, and the like, paratoluene sulfonic acid, and polyphosphoric acid may be added. Negative charge adjuvants increase the negative charge of the toner particle, while the positive charge adjuvants increase the positive charge of the toner particles. With the invention of the present application, the adjuvants or charge additives, can be comprised of the metal catechol and aluminum hydroxy acid complexes illustrated in U.S. Pat. Nos. 5,306,590; 5,306,591 and 5,308,731, the disclosures of which are totally incorporated herein by reference, and these additives have the following advantages over the aforementioned prior art charge additives: improved toner charging characteristics, namely, an increase in particle charge, as measured by ESA mobility, of from −1.4 E-10 $m^2/Vs$ to −2.3 E-10 $m^2/Vs$, that results in improved image development and transfer, from 80 percent to 93 percent, to allow improved solid area coverage, and a transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions since the measurements can be made at high volume loadings, for example, greater than or equal to 1.5 to 10 weight percent. Measurements generated by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in the mixture of high and low vapor pressure fluids, the thermoplastic resin, charging additive, and colorant in a manner that the resulting mixture contains, for example about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion.

In the initial mixture, the resin, colorant, and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient, liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant, and resin. However, the temperature at which this step is undertaken should not be so high as to degrade the nonpolar liquid or decompose the resin or colorant when present. Accordingly, the mixture can be heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes. After grinding at the above temperatures, an additional amount of nonpolar liquid may be added to the dispersion. The amount of nonpolar liquid to be added at this point should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of liquid developers are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. application Ser. No. 08/331,855 (D/94117), the disclosure of which is totally incorporated herein by reference, the image is developed with the liquid toner illustrated herein by, for example, immersion of the photoconductor therein, followed by transfer and fixing of the image.

Turning now to the Figure, there is shown a color document imaging system incorporating the present invention. The color copy process can begin by inputting a computer generated color image into the image processing unit 44. A digital signals which represent the blue, green, and red density signals of the image are converted in the image processing unit into four bitmaps: yellow (Y), cyan (C), magenta (M), and black (Bk). The bitmap represents the value of exposure for each pixel, the color components as well as the color separation. Image processing unit 44 may contain a shading correction unit, an undercolor removal unit (UCR), a masking unit, a dithering unit, a gray level processing unit, and other imaging processing sub-sytems known in the art. The image processing unit 44 can store bitmap information for subsequent images or can operate in a real time mode.

The photoconductive member, preferably a belt of the type which is typically multilayered and has a substrate, a conductive layer, an optional adhesive layer, an optional hole blocking layer, a charge generating layer, a charge transport layer, and, in some embodiments, an anti-curl backing layer. It is preferred that the photoconductive imaging member employed in the present invention be infrared sensitive this allows improved transmittance through cyan image. Belt 100 is charged by charging unit 101*a*. Raster output scanner (ROS) 20*a* and similarly ROS 20*b*, 20*c* and 20*d* are controlled by image processing unit 44, ROS 20*a* writes a first complementary color image bitmap information by selectively erasing charges on the belt 100. The ROS 20*a* writes the image information pixel by pixel in a line screen registration mode. It should be noted that either discharged area development (DAD) can be employed in which discharged portions are developed or charged area development (CAD) can be employed in which the charged portions are developed with toner. After the electrostatic latent image has been recorded, belt 100 advances the electrostatic latent image to development station 103*a*. Liquid developer material is supplied to development station 103*a* by replenishing systems, such as U.S. application Ser. No. (D/94624) entitled "A REPLENISHING SYSTEM" the disclosure of which is totally incorporated herein by reference. Roller 11, rotating in the direction of arrow 12, advances a liquid developer material 13*a* from the chamber of housing 14*a* to development zone 17*a*. An electrode 16*a* positioned before the entrance to development zone 17*a* is electrically biased to generate an AC field just prior to the entrance to development zone 17*a* so as to disperse the toner particles substantially uniformly throughout the liquid carrier. The toner particles, disseminated through the liquid carrier, pass by electrophoresis to the electrostatic latent image. The charge of the toner particles is opposite in polarity to the charge on the photoconductive surface.

After the image is developed it is conditioned at development station 103*a*. Development station 103*a* also includes porous roller 18*a* having perforations through the roller skin covering. Roller 18*a* receives the developed image on belt 100 and conditions the image by reducing fluid content while inhibiting the departure of toner particles from the image, and by compacting the toner particles of the image. Thus, an increase in percent solids is provided to the developed image, thereby improving the quality of the developed image. Preferably, the percent solids in the developed image is increased to more than increased to 20 percent solids. Porous roller 18*a* operates in conjunction with vacuum 19 (not shown) for removal of liquid from the roller. A roller (not shown), in pressure against the blotter roller 18*a*, may be used in conjunction with or in the place of the vacuum, to squeeze the absorbed liquid carrier from the blotter roller for deposit into a receptacle. Furthermore, the vacuum assisted liquid absorbing roller may also find useful application where the vacuum assisted liquid absorbing roller is in the form of a belt, whereby excess liquid carrier is absorbed through an absorbent foam layer. A belt used for collecting excess liquid from a region of liquid developed images is described in U.S. Pat. Nos. 4,299,902 and 4,258,115, the relevant portions of which are hereby incorporated by reference herein.

In operation, roller 18 rotates in direction 20 to impose against the "wet" image on belt 100. The porous body of roller 18 absorbs excess liquid from the surface of the image through the skin covering pores and perforations. Vacuum 19 located on one end of the central cavity of the roller, draws liquid that has permeated through roller 18 out through the cavity and deposits the liquid in a receptacle or some other location which will allow for either disposal or recirculation of the liquid carrier to a replenishing system. Porous roller 18, discharged of excess liquid, continues to rotate in direction 21 to provide a continuous absorption of liquid from image on belt 100. The image on belt 100 advances to lamp 34*a* where any residual charge left on the photoconductive surface is extinguished by flooding the photoconductive surface with light from lamp 34*a*.

The development takes place for the second color for example magenta, as follows: the developed latent image on belt 100 is recharged with charging unit 100*b*. The developed latent image is re-exposed by ROS 20*b*. ROS 20*b* superimposing a second color image bitmap information over the previous developed latent image. At development station B, roller 116, rotating in the direction of arrow 12, advances a liquid developer material 13 from the chamber of housing 14 to development zone 17*b*. An electrode 16*b* positioned before the entrance to development zone 17 is electrically biased to generate an AC field just prior to the entrance to development zone 17*b* so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image. Roller 18*b* receives the developed image on belt 100 and conditions the image by reducing fluid content while inhibiting the departure of toner particles from the image, and by compacting the toner particles of the image. Preferably, the percent solids is more than 20 percent, however, the percent of solids can range between 15 percent and 40 percent. The image on belt 100 advances to lamps 34*b* where any residual charge left on the photoconductive surface is extinguished by flooding the photoconductive surface with light from lamp 34.

The development takes place for the third color and fourth color, for example cyan and black in the same manner as describe above with the steps of charging, exposing, developing and conditioning for each color developed.

The resultant image, a multi layer image by virtue of the developing station 103*a*, 103*b*, 103*c* and 103*d* having black, yellow, magenta, and cyan, toner disposed therein advances to the intermediate transfer station. It should be evident to one skilled in the art that the color of toner at each development station could be in a different arrangement. The resultant image is electrostatically transferred to the intermediate member by charging device 111. The present invention takes advantage of the dimensional stability of the intermediate member to provide a uniform image deposition stage, resulting in a controlled image transfer gap and better image registration. Further advantages include reduced heating of the recording sheet as a result of the toner or marking particles being premelted, as well as the elimination of electrostatic transfer of charged particles to a recording sheet. Intermediate member 110 may be either a rigid roll or an endless belt having a path defined by a plurality of rollers in contact with the inner surface thereof. The multi layer image is conditioned by blotter roller 120 which receives the multi level image on intermediate member 110 and conditions the image by reducing fluid content while inhibiting the departure of toner particles from the image, and by compacting the toner particles of the image. Blotter roller 120 conditions the multi layer so that the image has a toner composition of more than 50 percent solids.

Subsequently, multi layer image, present on the surface of the intermediate member, is advanced through image transfer stage B. Within stage B, which essentially encompasses the region between when the toner particles contact the surface of member 110 and when they are transferred to recording sheet 26. Stage B includes a heating element 32 to cause softening and coalescing of the toner particles and removal of the high vapor pressure fluid present on the surface. Preferably, the image is heated between 90° to 150° C. At transfix nip 34, the liquefied toner particles are forced, by a normal force N applied through backup pressure roll 36, into contact with the surface of recording sheet 26. Moreover, recording sheet 26 may have a previously transferred toner image present on a surface thereof as the result of a prior imaging operation, i.e. duplexing. The normal force N, produces a nip pressure which is preferably about 100 psi, and may also be applied to the recording sheet via a resilient blade or similar spring-like member uniformly biased against the outer surface of the intermediate member across its width.

As the recording sheet passes through the transfix nip the tackified toner particles wet the surface of the recording sheet, and due to greater attractive forces between the paper and the tackified particles, as compared to the attraction between the tackified particles and the liquid-phobic surface of member 110, the tackified particles are completely transferred to the recording sheet as image marks 38. Furthermore, as the image marks were transferred to recording sheet 26 in a tackified state, they become permanent once they are advanced past transfix nip and allowed to cool. The transfixing of After the developed image is transferred to intermediate member 110, residual liquid developer material remains adhering to the photoconductive surface of belt 100. A cleaning roller 31 formed of any appropriate synthetic resin, is driven in a direction opposite to the direction of movement of belt 100 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamp 34*d*.

Specific embodiments of the invention will now be described in detail. These Examples are intended to be illustrative, and the invention is not limited to the materials, conditions, or process parameters set forth in these embodiments. All parts and percentages are by weight unless otherwise indicated. Comparative Examples are also provided.

EXAMPLE 1

Magenta Liquid Toner Concentrate

One hundred and sixty five and three tenths (165.3) grams of NUCREL 599® (a copolymer of ethylene and methacrylic acid with a melt index at 190° C. of 500 dg/minute, available from E. I. DuPont de Nemours & Company, Wilmington, Del.), 56.8 grams of the magenta pigment FANAL PINK™, 5.1 grams of aluminum stearate WITCO 22™ (Witco) and 307.4 grams of NORPAR 15®, carbon chain of 15 average (Exxon Corporation), were added to a Union Process 1S attritor (Union Process Company, Akron, Ohio) charged with 0.1875 inch (4.76 millimeters) diameter carbon steel balls. The mixture was milled at 125 rpm in the attritor which was heated to 83° C. to 96° C. for 2 hours by running steam through the attritor jacket and then an additional 147 grams of NORPAR 15® and 833 grams of Superla NF5® branched hydrocarbon liquid available from AMOCO) were added to the attritor and the attritor contents were cooled to 23° C. over 4 hours at a stir rate of 200 rpm by running cold water through the attritor jacket. An additional 1,532 grams of Superla NF5 15® were added, and the mixture was separated by the use of a metal grate from the steel balls yielding a liquid toner concentrate of 7.19 percent solids wherein solids include resin, charge adjuvant, and pigment and 92.81 percent liquid carrier. The particle diameter was 2.02 microns average by area as measured with the Horiba Cappa 500. This toner concentrate was used to prepare developers of Controls and in Examples.

EXAMPLE 2

Base Polymer Preparation 1

Sequential Group Transfer Polymerization (GTP) of 2-Ethylhexyl Methacrylate (EHMA) and 2-Dimethylaminoethyl Methacrylate (DMAEMA) to Prepare the AB Diblock Copolymer Precursor of Protonated Ammonium or Quaternary Ammonium Block Copolymer Charge Directors.

AB diblock copolymer precursors were prepared by a standard group transfer sequential polymerization procedure (GTP) wherein the ethylhexyl methacrylate monomer was first polymerized to completion and then the 2-dimethylaminoethyl methacrylate monomer was polymerized onto the living end of the ethylhexyl methacrylate polymer. All glassware was first baked out in an air convection oven at about 120° C. for about 16–18 hours.

In a typical procedure, a 2 liter 3-neck round bottom flask equipped with a magnetic stirring football, an Argon inlet and outlet and a neutral alumina (150 grams) column (later to be replaced by a rubber septum and then a liquid dropping funnel) is charged through the alumina column, which is maintained under a positive Argon flow and sealed from the atmosphere, with 415 grams (2.093 mole) of freshly distilled 2-ethylhexyl methacrylate (EHMA) monomer. Next 500 ml of freshly distilled tetrahydrofuran solvent, distilled from sodium benzophenone, is rinsed through the same alumina column into the polymerization vessel. Subsequently, the GTP initiator, 15 ml of methyl trimethylsilyl dimethylketene acetal (12.87 grams; 0.0738 mole) is syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 ml of a 0.66M solution of tetrabutylammonium acetate (catalyst) in the same dry tetrahydrofuran was syringed into the polymerization vessel. After an additional hour stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel. The polymerization solution was stirred under Argon for at least 4 hours after the temperature peaked. Then 5 ml of methanol was added to quench the live ends of the fully grown copolymer. The above charges of initiator and monomers provide an Mn and average degree of polymerization (DP) for each block. For the EHMA non-polar B block, the charged Mn is 5,621 and the DP is 28.3 and for the DMAEMA polar A block, the charged Mn is 1,219 and the DP is 7.8. $^1$H-NMR analysis of a 20% (g/dl) $CDCl_3$ solution of the copolymer indicated a 77 to 78 mole percent EHMA content and a 22 to 23 mole percent DMAEMA content. GPC analysis was obtained on a fraction of the 1–2 gram sample of isolated polymer using three 250×8 mm Phenomenex Phenogel ™ columns in series (100, 500, 1000 Angstrom) onto which was injected a 10 microliter sample of the block copolymer at 1% (wt/vol) in THF. The sample was eluted with THF at a flow rate of 1 ml/min and the chromatogram was detected with a 254 nm UV detector. The GPC chromatogram was bimodai with the major peak occurring at 13.4–22.2 counts and the minor low molecular weight peak at 23.5–28.3 counts. The major peak has a polystyrene equivalent number average molecular weight (Mn) of 2346 and a weight average molecular weight (Mw) of 8398 (MWD=3.58).

A small (1–2 grams) portion of the AB diblock copolymer can be isolated for GPC and $^1$H-NMR analyses by precipitation into 10× its solution volume of methanol using vigorous mechanical agitation. The precipitated copolymer was then washed on the funnel with more methanol and was then dried overnight in vacuo (about 0.5 Torr) at about 50° C.

EXAMPLE 3

Base Polymer Preparation 2

A second AB diblock copolymer was prepared as described in Example 2 using the same polymerization procedure, conditions, and quantities of the same materials except that more ketene acetal was used to initiate this GTP. In this preparation, 26 ml of the ketene acetal (22.31 grams;0.1280 mole) were used to initiate the polymerization. The above monomer charges are equivalent to 78.5 mole percent EHMA and 21.5 mole percent DMAEMA which corresponds to an EHMA average DP of 16.4 (Mn of 3243) and a DMAEMA average DP of 4.5 (Mn of 703). After solvent exchange as described above in Example 2, a 1–2 gram sample of the AB diblock copolymer was isolated by evaporating the toluene in a vacuum oven overnight at about 55° C. and 0.5 Torr and the dried AB diblock copolymer was next sampled for $^1$H-NMR analysis. $^1$H-NMR analysis of a 20% (g/dl) $CDCl_3$ solution of the AB dibiock copolymer indicated about a 79 to 80 mole percent EHMA repeat unit content and a 20 to 21 mole percent DMAEMA repeat unit content. GPC analysis, as described in Example 2, indicated the major peak at 14.5 to 19.9 counts to have a number average molecular weight of 3,912 and a weight average molecular weight of 6,222 (MWD of 1.59). Two barely discernible broad low molecular weight peaks were located at 20–25.1 and 25.1–30 counts.

EXAMPLE 4

Base Polymer Preparation 3

A third AB diblock copolymer was prepared as described in Example 3 using the same polymerization procedure and conditions except the polymerization scale was increased by a factor of three. $^1$H-NMR analysis of a 17.5% (g/dl) $CDCl_3$ solution of an isolated portion of the unprotonated block copolymer indicated about a 77 to 78 mole percent EHMA repeat unit content and a 22 to 23 mole percent DMAEMA repeat unit content. GPC analysis of this unprotonated block copolymer, as described in Example 2, indicated the major peak at 14.4–22.6 counts to have a number average molecular weight of 2253 and a weight average molecular weight of 5978 (MWD of 2.65). A broad low molecular weight peak was located at 24–32 counts. A hydrogen bromide protonated charge director was prepared from this AB diblock copolymer solution in toluene as described in Example 5.

EXAMPLE 5

Charge Director Preparation from Base Polymer Preparation 3

Preparation of the hydrogen bromide ammonium salt AB diblock copolymer charge director, poly[2-ethylhexyl methacrylate (B block)-co-N,N-dimethyl-N-ethyl methacrylate ammonium bromide (A block)], from poly [2-ethylhexyl methacrylate (B block)-co-N,N-dimethylamino-N-ethyl methacrylate (A block)] prepared in Example 4 and aqueous hydrogen bromide:

To a 1 liter Erlenmeyer flask was added 294.93 grams of a 50.86 weight percent toluene solution of an AB diblock copolymer (150 grams) from poly (2-ethylhexyl methacrylate-co-N,N-dimethylamino-N-ethyl methacrylate) prepared in Example 4 comprised of 18.23 weight percent 2-dimethylaminoethyl methacrylate (DMAEMA) repeat units and 81.77 weight percent 2-ethylhexyl methacrylate (EHMA) repeat units. The 150 grams of AB diblock copolymer contains 27.35 grams (0.174 mole) of DMAEMA repeat units. To this magnetically stirred AB dibiock copolymer toluene solution at about 20° C. was added 28.73 grams (0.170 mole of HBr) of 48% aqueous hydrobromic acid (Aldrich). The charged aqueous hydrobromic acid targeted 98.0 mole percent of the available DMAEMA repeat units in the AB diblock copolymer. A 2° C. exotherm was observed in the first 5 minutes, but after the addition of 23.4 grams of methanol, an 8° C. exotherm was observed in the next five minutes and then the temperature of the contents of the reaction vessel slowly began to drop. To reduce the viscosity of the reaction mixture, 150 grams additional toluene was added to give a 33 weight percent solids solution of moderate viscosity. This solution was magnetically stirred for 20 hours at ambient temperature and was then diluted with Norpar 15 (2850 grams) to give a 5 weight % (based on the corresponding starting weight of the AB diblock copolymer from Example 4) charge director solution after toluene and methanol rotoevaporation. Toluene and methanol were rotoevaporated at 50°–60° C. for 1–2 hours at 40–50 mm Hg from 500–600 ml portions of the charge director solution until the entire sample was rotoevaporated. The 5 weight % Norpar 15 solution of poly(2-ethylhexyl methacrylate-co-N,N-dimethyl-N-ethyl methacrylate ammonium bromide) had a conductivity of 1700 to 1735 pmhos/cm and was used to charge liquid toner concentrate prepared in Example 1 to give a megenta liquid developer as described in Example 6.

EXAMPLE 6

Megenta Liquid Developer Charged with Poly[2-Ethylhexyl Methacrylate (B Block)-Co-N,N-Dimethyl-N-Ethyl Methacrylate Ammonium Bromide (A Block)]

A megenta liquid toner dispersion (developer) was prepared by taking 890.2 grams of liquid toner concentrate (7.19% solids in Norpar 15 and SUPERLA NF5 with the ink solids being thermoplastic resin, pigment, and charge adjuvant) from Example 1 and adding to it 2059 grams of Isopar L, 436 grams of SUPERLA, and 36.0 grams of charge director (5% solids in Norpar 15) from Example 5. This resulted in a liquid toner dispersion of 2% toner solids where the liquid carrier consists of 62% ISOPAR L®, 34% SUPURLA NF5®, 4% Norpar 15® and 30 mg charge director (CD) to 1 gram of toner solids or 3.0% charge director per gram of toner solids. This megenta developer was then used in a color electrophotographic printing machine as describe in the figure and the follow data was obtained:

Test images consisting of solid patches were developed onto the photoreceptor, a sample of the developer liquid were extracted and tested with FTIR Analysis. It was found that the developed image had 5–6% toner solids, and the carrier consisted of 64% ISOPAR L®, 29% SUPURLA NF5®, 7% Norpar 15®. The developed image was conditioned. A sample of the conditioned image was tested with FTIR Analysis and it was found that the developed image had 10–12% toner solids and the carrier consisted of 61% ISOPAR L®, 33% SUPURLA NF5®, 6% Norpar 15®.

The developed image was transfer onto an intermediate belt and transfer onto paper. A patch sample of the developed image was tested having the transfix roller being at ambient temperature of 20° C. it was found that the developed image had 20% toner solids, and the liquid carrier consisted of 30% ISOPAR L®, 54% SUPURLA NF5®, 16% Norpar 15® and between 40–60% of the image transferred to the paper. It was observed that the image on the paper smeared easily.

A second sample patch of the developed image was tested having 600 watts applied to the transfix roller, it was found that the developed image had 19% toner solids and the liquid carrier consisted of 25% ISOPAR L®, 66% SUPURLA NF5 ®, 9% Norpar 15®and between 95–100% of the image transfered to the paper. It was observed that the image on the paper smeared easily and the fix was poor.

A third patch sample of the developed image was tested having 1940 watts applied to the transfix roller and one lamp radiating the image on the intermediate belt, it was found that the developed image had 22% toner solids and the liquid carrier consisted of 18% ISOPAR L®, 72% SUPURLA NF5®, 10% Norpar 15® and between 95–100% of the image transfered to the paper. It was observed that the image on the paper did not smear easily and the fix was good.

A fourth patch sample of the developed image was tested having 4620 watts applied to the transfix roller and three lamps radiating the image on the intermediate belt, it was found that the developed image had 24% toner solids and and the liquid carrier consisted of, 13% ISOPAR L®, 75% SUPURLA NF5®, 11% Norpar 15® and between 95–100% of the image transfered to the paper. It was observed that the image on the paper did not smear easily and the fix was good.

From these experiments, we can see that good fix and smear levels are obtained once the solids level exceeds 20%. Control of the residual carrier becomes relatively easy since the high vapor pressure constituent (Isopar L) is removed leaving behind the low vapor pressure constituents. Formulations with higher ratios of Isopar L will reduce the residual Norpar 15 and/or SUPERLA. This example was merely to demonstrate the effect. An ideal ink would be formulated to leave a 0% solids image by reducing the level of low vapor pressure carrier constituent.

Other modifications of the present invention may occur to those skilled in the art based upon a reading of the present disclosure and these modifications are intended to be included within the scope of the present invention.

What is claimed is:

1. An imaging method, comprises:

forming an electrostatic latent image;

developing the electrostatic latent image with the liquid developer comprising a mixture of a hihh vapor pressure carrier fluid and a low vapor pressure carrier fluid; a thermoplastic resin; and a pigment;

removing the high vapor pressure carrier fluid from the developed electrostatic latent image; and transferring from about 80 to about 100 percent of the developed electrostatic latent image to paper.

2. A developer in accordance with claim 1, wherein the high vapor pressure carrier fluid has a vapor pressure ranging from about 0.1 Torr to about 2.5 Torr at 20° C.

3. A developer in accordance with claim 1, wherein the low vapor pressure carrier fluid has a vapor pressure ranging from about 0.0001 Torr to about 0.25 Torr at 20° C.

4. A developer in accordance with claim 1, wherein the high vapor pressure carrier fluid and the low vapor pressure carrier fluid have a pressure ratio ranging from about 10:1 to about 10000:1.

5. A developer in accordance with claim 1, wherein the mixture comprises about 50 to about 80 weight percent of the high vapor pressure fluid, and from about 50 to about 20 weight percent of the low vapor pressure fluid.

6. A developer in accordance with claim 1, wherein the mixture comprises about 25 to 75 weight percent of the high vapor pressure fluid, and about 25 to 75 weight percent of the low vapor pressure fluid.

7. A developer in accordance with claim 1, wherein the high vapor pressure carrier fluid comprises an aliphatic hydrocarbon.

8. A developer in accordance with claim 1, wherein the high vapor pressure carrier fluid comprises an aliphatic hydrocarbon.

9. A developer in accordance with claim 1, wherein the low vapor pressure carrier fluid comprises a branched hydrocarbon.

10. A developer in accordance with claim 1, wherein the low vapor pressure carrier fluid comprises a linear hydrocarbon including from about 14 to about 16 carbon atoms.

11. A developer in accordance with claim 1, wherein the low vapor pressure fluid comprises a mixture of a plurality of different low vapor pressure fluids.

12. A developer in accordance with claim 1, wherein the liquid comprises the developer mixture of carrier fluids ranging from about 85 percent to about 99.9 percent by weight, based on the total weight of the liquid developer; developer solids ranging from about 0.1 percent to about 15 percent by weight.

13. A developer in accordance with claim 1, wherein the pigment comprises black, cyan, magenta, yellow, red, green, brown or mixtures thereof.

14. An imaging method in accordance with claim 1, further comprising:

transferring the developed electrostatic latent image to an intermediate substrate subsequent to said removing step.

* * * * *